US005727697A

United States Patent [19]

Ricciardelli et al.

[11] Patent Number: 5,727,697

[45] Date of Patent: Mar. 17, 1998

[54] ORGANIZING DEVICE

[75] Inventors: Joseph J. Ricciardelli; Charles A. Wick, III, both of Coppell, Tex.

[73] Assignee: Universal Designs, Inc., Coppell, Tex.

[21] Appl. No.: 588,381

[22] Filed: Jan. 18, 1996

[51] Int. Cl.[6] ..... A47F 5/00

[52] U.S. Cl. ..... 211/89; 211/94; 248/225.11

[58] Field of Search ..... 211/94, 87, 89, 211/70.6, 60.1; 248/225.11

[56] References Cited

U.S. PATENT DOCUMENTS

| | | | |
|---|---|---|---|
| 655,739 | 8/1900 | Runtz | 211/94 X |
| 754,503 | 3/1904 | Rubicam et al. | 211/87 X |
| 1,188,227 | 6/1916 | Woods et al. | 211/87 X |
| 1,223,998 | 4/1917 | Maynard | 211/87 |
| 2,430,624 | 11/1947 | Vollmer | 211/89 X |
| 2,569,021 | 9/1951 | Rozanski | 211/89 |
| 2,707,052 | 4/1955 | Brown | 211/65 |
| 3,812,976 | 5/1974 | Rempel | 211/70.6 |
| 3,894,707 | 7/1975 | Heard | 248/225.11 X |
| 4,211,381 | 7/1980 | Heard | 248/225.11 X |
| 4,467,925 | 8/1984 | Ratzloff et al. | 211/70.6 |
| 4,880,192 | 11/1989 | Vom Braucke et al. | 211/89 X |
| 4,936,469 | 6/1990 | Drower | 211/69.8 |
| 5,005,710 | 4/1991 | Hofer | 211/70.6 |
| 5,419,443 | 5/1995 | Niederberger et al. | 211/70.6 |

FOREIGN PATENT DOCUMENTS

| | | |
|---|---|---|
| 3490321 | 4/1992 | Germany . |
| 8604291 | 7/1986 | WIPO . |

*Primary Examiner*—Robert W. Gibson, Jr.
*Attorney, Agent, or Firm*—Baker & Botts, L.L.P.

[57] ABSTRACT

An organizing device (10) includes a platform (12) having a first end (2), a second end (4), and a channel (20) extending along at least a portion of the platform (12) between the first end (2) and the second end (4). A plurality of securing members (28) are coupled to the platform (12) using the channel (20). Each securing member (28) exerts a securing force upon one or more adjacent securing members (28). The device (10) secures an item (31) placed between adjacent securing members (28) using the securing force. The plurality of securing members (28) includes a hooking element (46) having a hook (86) and operable to support an item using the hook (86).

21 Claims, 3 Drawing Sheets

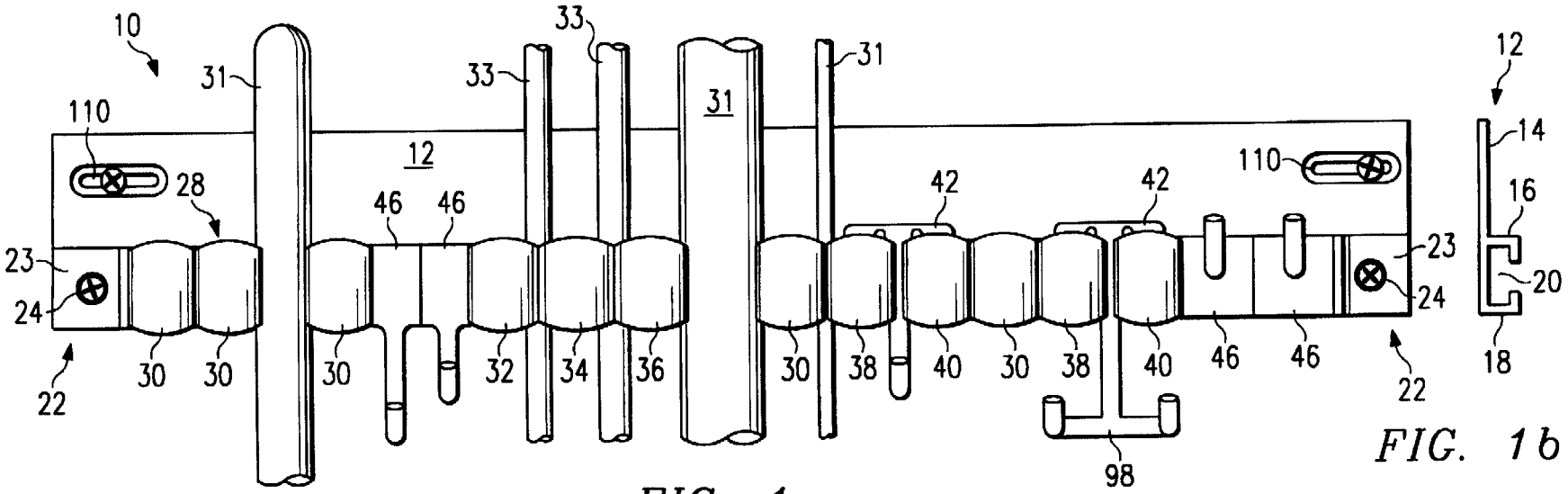
FIG. 1b
FIG. 1a
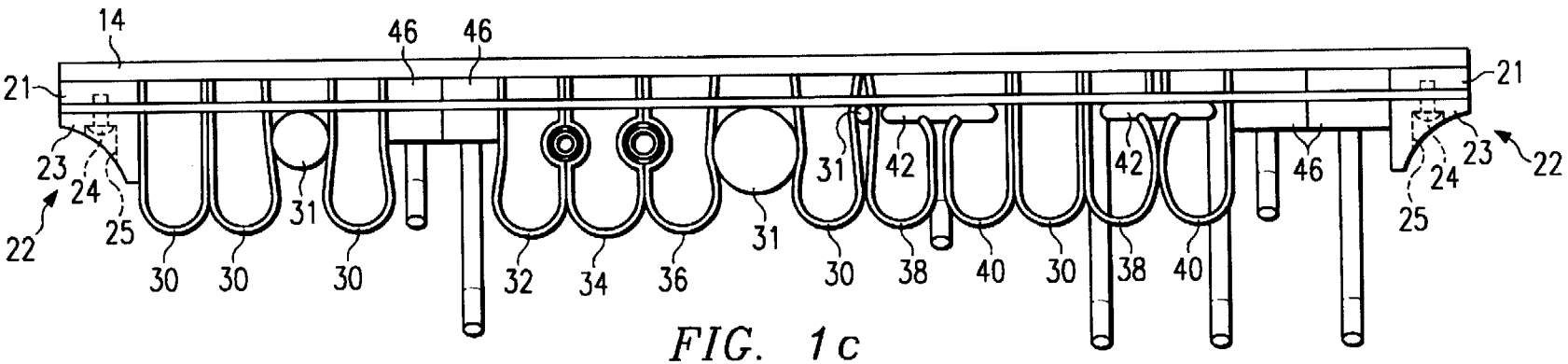
FIG. 1c

ORGANIZING DEVICE

TECHNICAL FIELD OF THE INVENTION

This invention relates in general to the field of organization, and more particularly to an organizing device.

BACKGROUND OF THE INVENTION

Many activities and environments require persons performing these activities and inhabiting these environments to use various tools, objects, or other items associated with these activities and environments. Unorganized distribution of these items in an environment may decrease the safety and efficiency of persons or activities associated with that environment.

As the activities people perform and the environments people inhabit become more complex to serve a variety of functions and space considerations, persons performing these activities and inhabiting these environments may desire to organize and secure items in order to increase safety and efficiency according to their needs. A known organization technique allows persons to place loose items in a clip affixed to an upright surface. However, such systems may have difficulty accommodating a large number of items. Further, users may not be able to easily remove items from such systems once secured.

Another known organization technique uses a number of flexible plastic loops that, when connected to a frame, may exert lateral forces upon one another and upon items inserted between the loops in order to secure such items. However, these systems suffer from a lack of adaptability, and may have difficulty accommodating several different types of items or items having particular shapes.

SUMMARY OF THE INVENTION

In accordance with the present invention, the disadvantages and problems associated with organizing devices have been substantially reduced or eliminated.

In accordance with one embodiment of the present invention, an organizing device includes a platform having a first end, a second end, and a channel extending along at least a portion of the platform between the first and second ends. A plurality of securing members are coupled to the platform using the channel. Each securing member exerts a securing force upon one or more adjacent securing members. The device secures an item placed between adjacent securing members using the securing force. The plurality of securing members includes a hooking element having a hook and operable to support an item using the hook.

Important technical advantages of the present invention include providing an organizing device that allows persons to more easily secure selected tools and other objects when these items are not in use, and to more easily access these items when they are needed. Using the present invention, items may be secured between securing members using the force exerted by one securing member upon an adjacent securing member. Because of its shape and construction, the present invention is adaptable to secure many different items of various shapes and sizes. Another important technical advantage includes providing an organizing device that may include a hooking element for supporting an item not secured between securing members. A further technical advantage of the present invention includes a flow-through member that may receive and secure a fluid tube, while allowing fluid to flow within the tube when the fluid tube is secured. Other technical advantages are readily apparent to one skilled in the art from the following figures, descriptions, and claims.

BRIEF DESCRIPTION OF THE INVENTION

For a more complete understanding of the present invention and for further features and advantages, reference is now made to the following description taken in conjunction with the accompanying drawings, in which:

FIGS. 1*a*–1*c* illustrate top, side, and bottom views, respectively, of an organizing device;

FIG. 1*d* illustrates an organization device having a curved platform.

FIGS. 2*a*–2*c* illustrate forming a loop member and coupling the loop member to a platform;

FIGS. 3*a* and 3*b* illustrate side views of hooking elements coupled to a platform;

DETAILED DESCRIPTION OF THE INVENTION

Figure 1D:
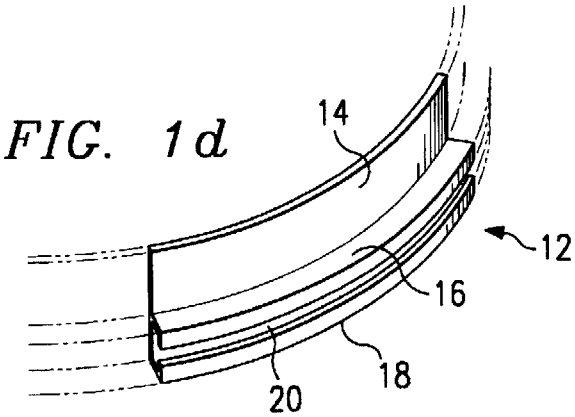

FIGS. 1*a*–1*c* illustrate an organizing device 10 that includes a platform 12. As shown in FIG. 1*b*, platform 12 includes a back plate 14, a top flange 16, and a bottom flange 18. Back plate 14 may include one or more slots 110 operable to receive one or more supporting agents for supporting device 10 or securing device 10 to a desired surface. In one embodiment, top flange 16 and bottom flange 18 project from back plate 14 in a generally perpendicular and forward direction, relative to back plate 14. Back plate 14, top flange 16, and bottom flange 18 form the walls of channel 20.

Top flange 16 and bottom flange 18 may project from back plate 14 along the entire length of platform 12, along only a portion of the length of platform 12, or along a plurality of portions of the length of platform 12. Top flange 16 and bottom flange 18 may project from back plate 14 at any angle, relative to back plate 14, and may project from back plate 14 at different angles, relative to one another. The present invention contemplates any configuration of back plate 14, top flange 16, and bottom flange 18 suitable to form channel 20 along at least a portion of the length of platform 12. For example, platform 12 may be curved, having a curved back plate 14, a curved top flange 16, and a curved bottom flange 18, as shown in FIG. 1*d*.

In one embodiment, a plurality of top flanges 16 and bottom flanges 18 are operable to form a plurality of channels 20. Each channel 20 is formed laterally, vertically, or both laterally and vertically, relative to back plate 14, along at least a portion of platform 12. Each channel 20 may be offset from other channels 20 laterally, vertically, or both laterally and vertically, relative to back plate 14. The present invention contemplates any configuration of back plate 14, top flanges 16, and bottom flanges 18 suitable to form a plurality of channels 20 along at least a portion of platform 12.

As shown in FIGS. 1*a* and 1*c*, a plurality of securing members 28 are coupled to platform 12 using top flange 16, bottom flange 18, and channel 20. Securing members 28 include side stops 22, loop members 30, flow-through members 32, 34, and 36, notched members 38 and 40, and hooking elements 46. The present invention contemplates other securing members 28 suitable to secure tools or other objects in a similar manner to that described herein.

Side stops 22 include a coupling segment 21 and a body segment 23. Coupling segment 21 and body segment 23 are partially separated by notches operable to receive top flange 16 and bottom flange 18 when side stops 22 are coupled to platform 12. Coupling segment 21 may be integral to or separate from body segment 23. In one embodiment, side stops 22 are operable to slide along at least a portion of the length of channel 22 when side stops 22 are not fixedly secured to platform 12. Side stops 22 may be fixedly secured to platform 12 near the ends of platform 12 using screws 24. Screw 24 is recessed into hole 25 in body segment 23, and is operable to bring coupling segment 21 and body segment 23 tightly into contact with top flange 16 and bottom flange 18 to secure side stop 22 to platform 12. The present invention contemplates other fastening agents to fixedly secure side stops 22 to platform 12. The present invention further contemplates side stops 22 that are integral to platform 12.

Loop members 30, flow-through members 32, 34, and 36, notched members 38 and 40, and hooking elements 46 are coupled to platform 12 between side stops 22 using top flange 16, bottom flange 18, and channel 20. In one embodiment, each securing member 28 is operable to exert a generally lateral securing force upon one or more adjacent securing members 28 along the general direction of channel 20. When side stops 22 are fixedly secured to platform 12, device 10 is operable to maintain the generally lateral securing forces exerted between adjacent securing members 28 and prevent securing members 28 from escaping laterally from channel 20.

When an item 31, for example, a tool or other object, is inserted between adjacent securing members 28, device 10 is operable to secure item 31 using the generally lateral securing forces exerted by adjacent securing members 28 on item 31. In one embodiment, item 31 is inserted between adjacent securing members 28 from a generally forward position, relative to back plate 14. Due to the construction of securing members 28, the insertion of item 31 between adjacent securing members 28 causes adjacent securing members 28 to move laterally apart from one another in an amount sufficient to allow item 31 to rest between and be secured by adjacent securing members 28. In one embodiment, as additional items 31 are inserted between and secured by the various securing members 28, the securing force exerted by each securing member 28 on one or more adjacent securing members 28 increases accordingly.

Item 31 may be removed from between adjacent securing members 28 by exerting a removal force on item 31 sufficient to release item 31 from between adjacent securing members 28. The removal force exerted on item 31 may be in a forward, upward, or downward direction, relative to platform 12, or in any combination of the forward, upward, and downward directions suitable to remove item 31 from between adjacent securing members 28. The removal force exerted on item 31 may additionally have a lateral component, relative to platform 12. In one embodiment, as items 31 are removed from between the various securing members 28, the securing force exerted by each securing member 28 on one or more adjacent securing members 28 decreases accordingly.

Figure 2C:
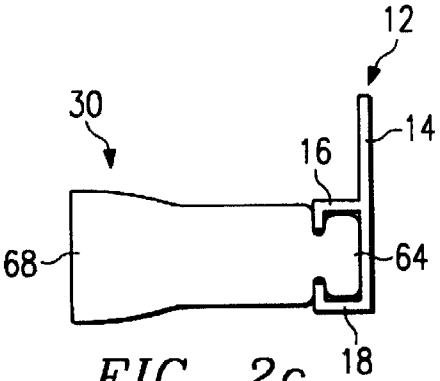
Figure 2B:
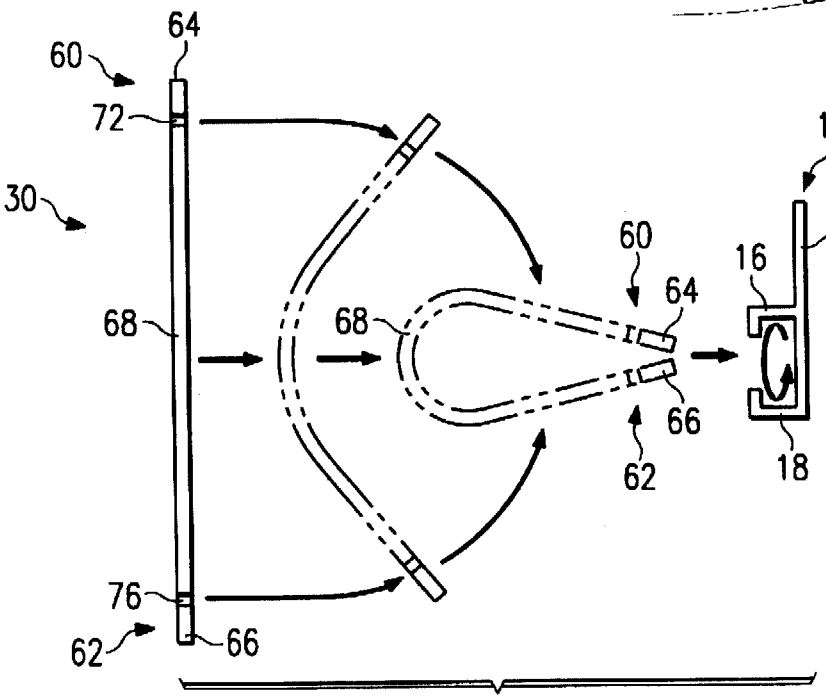
Figure 2A:
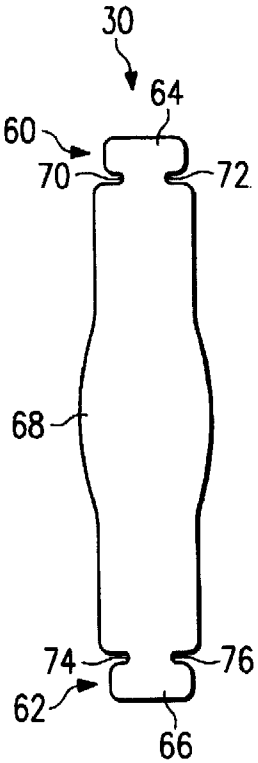

FIGS. 2*a*–2*c* illustrate forming loop member 30 and coupling loop member 30 to platform 12. In one embodiment, loop member 30 begins as an elongated, generally rectangular sheet of flexible material, for example, low density polyethylene plastic or other appropriate material. Loop member 30 includes a first end 60 and a second end 62. Tab portions 64 and 66 are located at or near first and second ends 60 and 62, respectively, and body portion 68 is located generally between tab portions 64 and 66. Tab portions 64 and 66 are partially separated from body portion 68 by notches 70 and 72, and notches 74 and 76, respectively. Tab portions 64 and 66 may be integral to or separate from body portion 68. Body portion 68 bows outward along both sides near the midline between tab portions 64 and 66. The present invention contemplates forming loop member 30 from a sheet of any shape and any material suitable to allow loop member 30 to cooperate with an adjacent securing member 28 to secure an item 31 between loop member 30 and adjacent securing member 28.

As shown in FIG. 2*b*, first and second ends 60 and 62, respectively, may be placed in closer proximity by folding loop member 30 upon itself about the midline between tab portions 64 and 66. When first and second ends 60 and 62, respectively, are in close enough proximity, tab portions 64 and 66 may be inserted into channel 20 of platform 12 and loop member 30 turned approximately ninety degrees. When first and second ends 60 and 62, respectively, are released, first and second ends 60 and 62, respectively, may expand laterally apart from one another along the direction of channel 20 until first and second ends 60 and 62, respectively, contact adjacent securing members 28. In one embodiment, tab portions 64 and 66 of each loop member 30 coupled to platform 12 in the manner described above are positioned within channel 20 as shown in FIG. 2*c*.

When a loop member 30 and a plurality of other securing members 28 are coupled to platform 12 between side stops 22, loop member 30 is operable to exert generally lateral securing forces upon adjacent securing members 28 due to the construction and resulting elastic behavior of loop member 30. The behavior of loop member 30 may resemble that of a spring positioned between adjacent securing members 28. In one embodiment, adjacent securing members 28 include one or more loop members 30. When a plurality of loop members 30 are coupled to platform 12, each loop member 30 is operable to behave in the manner described above to exert a generally lateral securing force upon adjacent securing members 28. The present invention contemplates any suitable securing member 28, for example, flow-through member 32, replacing or combining with the functions of any loop member 30 when a plurality of securing members 28 are coupled to platform 12 using channel 20.

Figure 3A:
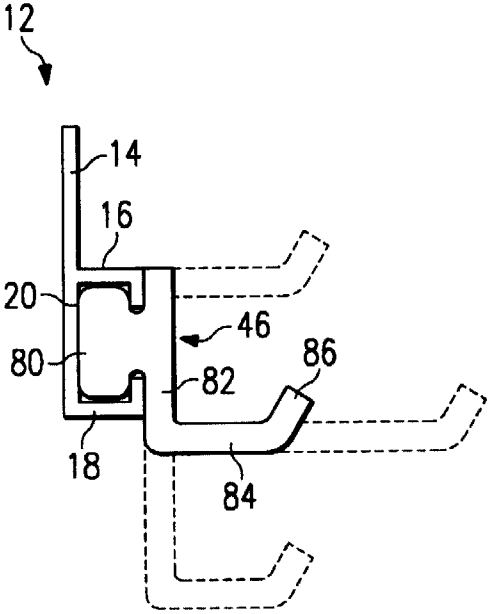
Figure 3B:
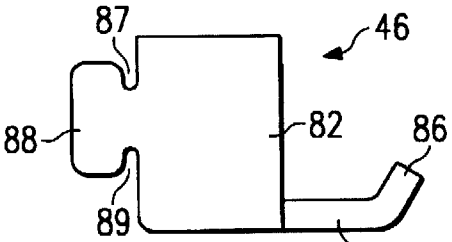

FIGS. 3*a* and 3*b* illustrate hooking elements 46 operable to couple to platform 12 using channel 20 and to support loads placed upon hooking elements 46 in the form of tools, objects, or other items 31. In the embodiment shown in FIG. 3*a*, hooking element 46 includes a coupling segment 80 that may be slidingly inserted into channel 20 from either end of channel 20 before one or both side stops 22 are fixedly coupled to platform 12. Due to the cooperating shapes of coupling segment 80, channel 20, top flange 16, and bottom flange 18, hooking element 46 may slide along at least a portion of the length of channel 20 until hooking element 46 reaches a desired position. Alternatively, hooking element 46 may be integral to platform 12. In one embodiment, one or more hooking elements 46 are slidingly coupled to platform 12 before another securing member 28, for example, loop member 30, is coupled to platform 12.

In addition to coupling segment 80, hooking element 46 includes vertical member 82, projecting member 84, and hook 86. Coupling element 80, vertical member 82, projecting member 84, and hook 86 may be integral to or separate from one another and may be constructed from the same or different materials. In one embodiment, hooking element 46 is constructed from a relatively rigid material, for example, metal, high density plastic, or any other material suitable to allow coupling element 80 to slide within channel 20 and maintain its shape while supporting an item 31.

As indicated by the dashed lines in FIG. 3*a*, vertical member 82 may be constructed to extend generally upward or downward, relative to coupling segment 80, as far as desired. Similarly, projecting member 84 may be constructed to project generally forward from vertical member 82, relative to vertical member 82, and may couple to vertical member 82 at any desired angle. Hook 86 may align forwardly with projecting member 84 to form an extension of projecting member 84 or may couple to projecting member 84 at any desired angle. In one embodiment, projecting member 84 is bifurcated and includes a lateral arm operable to couple the bifurcations of projecting member 84 to vertical member 96. The present invention contemplates other configurations of vertical member 82, projecting member 84, and hook 86 suitable to allow hooking element 46 to support an item 31.

As shown in FIG. 3*b*, hooking element 46 may be constructed and coupled to platform 12 in a similar manner as loop member 30, as described above in connection with FIGS. 2*a*–2*c*. In one embodiment, hooking element 46 begins as an elongated, generally rectangular sheet of flexible material, for example, low density polyethylene plastic or other appropriate material. Tab portions 88 are located at or near the ends of the sheet and are partially separated from vertical member 82, located generally between tab portions 88, by notches 87 and 89. Vertical member 82 bows outward along both sides and couples to projecting member 84 at or near the midline between tab portions 88. Hook 86 is coupled to projecting member 84 at any desired angle. Tab portions 88, vertical member 82, projecting member 86, and hook 86 may be integral to or separate from one another.

In one embodiment, hooking element 46 is operable to cooperate with an adjacent securing member 28 to removably secure an item 31 between hooking element 46 and adjacent securing member 28. Hooking element 46 is operable to behave in the same manner as loop member 30, described above, by exerting a generally lateral securing force upon item 31 that cooperates with a corresponding securing force exerted upon item 31 by adjacent securing member 28. The present invention contemplates forming hooking element 46 in any shape and from any material suitable to allow hooking element 46 to cooperate with adjacent securing member 28 to removably secure item 31 between hooking element 46 and adjacent securing member 28.

Figure 4:
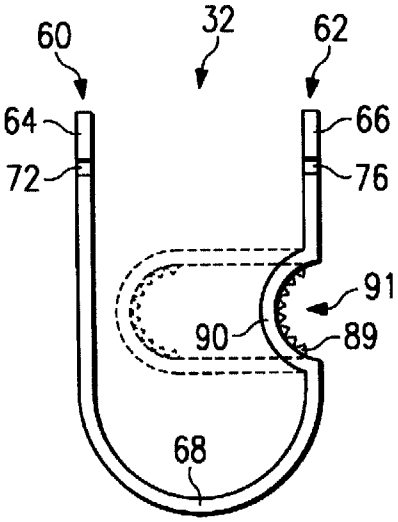
FIG. 4 is a top view of a flow-through member.

FIG. 4 illustrates flow-through member 32 that includes ends 60 and 62, tab portions 64 and 66, notches 70, 72, 74, and 76, and body portion 68. In one embodiment, flow-through member 32 is constructed and coupled to platform 12 in a similar manner as loop member 30, as described above in connection with FIGS. 2*a*–2*c*. Flow-through member 32 includes a curved portion 90 along a region of body portion 68 near second end 62. Curved portion 90 forms a bay 91 operable to receive at least a portion of a fluid tube 33. In one embodiment, the radius of fluid tube 33 is nearly equal to the radius of bay 91. As indicated by the dashed lines, the present invention contemplates flow-through member 32 having a bay operable to receive the entirety of fluid tube 33. The present invention further contemplates flow-through member 32 having a plurality of curved portions 90 and bays 91 located near second end 62.

In one embodiment, flow-through member 32 is operable to cooperate with an adjacent flow-through member 34 having a cooperating curved portion 90 and bay 91 to removably secure fluid tube 33 between flow-through members 32 and 34. In cooperation, flow-through members 32 and 34 are operable to allow fluid to flow through fluid tube 33 while fluid tube 33 is secured between flow-through members 32 and 34. Curved portion 90 of flow-through member 32 and the cooperating curved portion 90 of flow-through member 34 may be constructed so as to cooperatively receive and secure a fluid tube 33 of any size desired. As shown in FIGS. 1*a* and 1*c*, a plurality of flow-through members 32, 34, and 36 may be placed adjacent one another to removably secure a plurality of fluid tubes 33 between flow-through members 32, 34, and 36.

In one embodiment, the laterally outward surface of curved portion 90 includes a friction surface 89 operable to restrict the movement of fluid tube 33 within bay 91 while fluid tube 33 is removably secured using bay 91. Friction surface 89 is further operable to allow bay 91 to receive and secure fluid tube 33 even though the radius of fluid tube 33 may be slightly smaller than the radius of bay 91. Friction surface 89 may be integral to or separate from flow-through member 32 and may be constructed from any material suitable to restrict the movement of fluid tube 33 within bay 91.

The upper, lower, forward, and rearward outward edges of curved portion 90, relative to back plate 14, may be rounded or smooth. Smooth upper and lower edges may be desirable, for example, when fluid tube 33 is removed from between flow-through members 32 and 34 upwardly or downwardly, relative to back plate 14, rather than by separating flow-through members 32 and 34 and removing fluid tube 33 forwardly, relative to back plate 14. A smooth forward edge may be desirable, for example, when fluid tube 33 is removed from between flow-through members 32 and 34 forwardly, relative to back plate 14, in haste or without first separating flow-through members 32 and 34 and removing fluid tube 33. The present invention contemplates other configurations of flow-through members 32, 34, and 36 suitable to allow flow-through members 32, 34, and 36 to removably secure one or more fluid tubes 33, while allowing fluid to flow through fluid tubes 33 while fluid tubes 33 are secured between flow-through members 32, 34, and 36.

Figure 5:
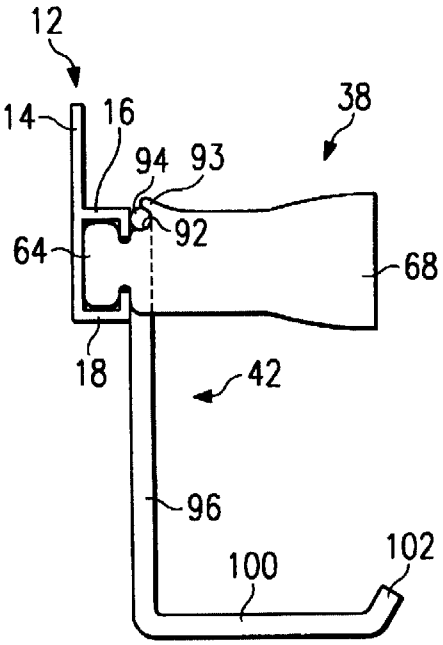
FIG. 5 is a side view of a notched member supporting a hooking member and coupled to a platform.

FIG. 5 illustrates notched member 38 coupled to platform 12. In one embodiment, notched member 38 is constructed and coupled to platform 12 in a similar manner as loop member 30, as described above in connection with FIGS. 2*a*–2*c*. Notched member 38 includes first and second ends 60 and 62, respectively, tab portions 64 and 66, notches 70, 72, 74, and 76, and body portion 68. Notched member 30 also includes a supporting notch 92 and a clasp 93 operable in combination to receive and removably secure horizontal member 94 of secured hooking member 42. In one embodiment, adjacent notched members 38 and 40 are operable to exert generally lateral securing forces on the respective opposing sides of secured hooking member 42. Using these generally lateral securing forces, in addition to supporting notch 92 and clasp 93, secured hooking member 42 may be removably secured between adjacent notched members 38 and 40.

In addition to horizontal member 94, secured hooking member 42 includes vertical member 96, projecting member 100, and hook 102. Horizontal member 94, vertical member 96, projecting member 100, and hook 102 may be integral to or separate from one another and may be constructed from the same or different materials. In one embodiment, secured hooking member 42 is constructed from a relatively rigid material, for example, metal, high density plastic, or any other material suitable to allow secured hooking member 42 to support a load in the form of a tool, object, or other item 31.

Vertical member 96 is coupled to horizontal member 94 and may extend generally upward or downward from horizontal member 96, relative to back plate 14, as far as desired. Vertical member 96 may couple to horizontal member 94 at any angle, relative to back plate 14. Similarly, projecting member 100 is coupled to and may project generally forward from vertical member 96, relative to platform 12, as far as desired. Projecting member 100 may couple to vertical member 96 at any angle, relative to back plate 14. Hook 102 may align forwardly with projecting member 100 to form an extension of projecting member 100, or may couple to projecting member 100 at any desired angle. In one embodiment, projecting member 100 is bifurcated and includes a lateral arm 98 operable to couple the bifurcations of projecting member 100 to vertical member 96, as shown in FIG. 1*a*. The present invention contemplates other configurations of horizontal member 94, vertical member 96, projecting member 100, and hook 102 suitable to allow secured hooking member 42 to support an item 31 while removably secured to device 10 using adjacent notched members 38 and 40.

Although several securing members 28 have been described above, the present invention contemplates combining the functions or constructions of two or more securing members 28 to provide additional securing members 28. For example, notched member 38 may include a curved portion similar to curved portion 90 of flow-through member 32. Notched member 38 may then be operable to receive and secure fluid tube 33, while allowing fluid to flow within fluid tube 33 while fluid tube 33 is secured between notched member 38 and an adjacent securing member 28. The present invention contemplates as many other combinations of securing members 28 as are suitable to allow device 10 to secure one or more desired items 31.

Although the present invention has been described with several embodiments, a plethora of changes, variations, alterations, modifications, transformations, and substitutions may be suggested to one skilled in the art, and it is intended that the present invention encompass such changes, variations, alterations, modifications, transformations, and substitutions as fall within the spirit and scope of the appended claims.

What is claimed is:

1. An organizing device, comprising:

a platform having a first end, a second end, and a channel extending along at least a portion of the platform between the first and second ends; and a plurality of securing members coupled to the platform using the channel, each securing member operable to exert a securing force upon one or more adjacent securing members, the device operable to secure an item placed between adjacent securing members using the securing force, wherein the plurality of securing members includes a hooking element having a hook and operable to support an item using the hook.

2. The device of claim 1, wherein the plurality of securing members includes a loop member having one or more tab portions, the loop member removably coupled to the platform using the tab portions, the tab portions operable to slide within the channel along at least a portion of the channel.

3. The device of claim 2, wherein the loop member is operable to cooperate with an adjacent loop member to secure an item placed between the loop member and the adjacent loop member.

4. The device of claim 2, wherein the loop member is formed by folding a sheet of flexible material having first and second ends upon itself so as to place the first and second ends in closer proximity, the first and second ends each having an associated tab portion.

5. The device of claim 1, wherein the plurality of securing members includes a flow-through member operable to receive a fluid tube, the flow-through member operable to allow fluid to flow within the fluid tube while the fluid tube is secured using the flow-through member.

6. The device of claim 5, wherein the flow-through member is operable to cooperate with an adjacent securing member to receive and secure the fluid tube.

7. The device of claim 1, wherein the plurality of securing members includes a notched member having a notch, the notched member operable to receive at least a portion of a secured hooking member secured between the notched member and an adjacent securing member.

8. The device of claim 7, wherein the notched member is operable to cooperate with an adjacent notched member to receive and secure the secured hooking member.

9. The device of claim 1, wherein the channel is curved.

10. An organizing device, comprising:

a platform having a first end, a second end, and a channel extending along at least a portion of the platform between the first and second ends;

a securing member coupled to the platform using the channel; and a flow-through member coupled to the platform using the channel and operable to receive a fluid tube, the flow-through member operable to exert a securing force upon the securing member, the flow-through member operable to cooperate with the securing member to secure the fluid tube between the flow-through member and the securing member using the securing force, the flow-through member operable to allow fluid to flow within the fluid tube while the fluid tube is secured.

11. The device of claim 10, wherein the flow-through member has one or more tab portions, the flow-through member coupled to the platform using the tab portions, the tab portions operable to slide within the channel along at least a portion of the channel.

12. The device of claim 10, wherein the securing member is an adjacent flow-through member.

13. The device of claim 10, wherein the flow-through member includes a curved portion operable to receive the fluid tube.

14. The device of claim 10, wherein the securing member is an adjacent flow-through member, the flow-through member includes a first curved portion, and the adjacent flow-through member includes a second curved portion, the first and second curved portions operable to cooperate to receive and secure the fluid tube between the flow-through member and the adjacent flow-through member.

15. The device of claim 10, wherein the flow-through member includes a friction surface operable to restrict the movement of the fluid tube while the fluid tube is secured between the flow-through member and the securing member.

16. An organizing device, comprising:

a platform having a first end, a second end, and a channel extending along at least a portion of the platform between the first and second ends;

a securing member coupled to the platform using the channel;

a notched member coupled to the platform using the channel and operable to exert a securing force upon the securing member; and a secured hooking member, the notched member operable to receive the secured hooking member and to cooperate with the securing member to secure the secured hooking member between the notched member and the securing member using the securing force.

17. The device of claim 16, wherein the securing member is an adjacent notched member.

18. The device of claim 16, wherein:

the secured hooking member includes a lateral member and a vertical member;

the securing member is an adjacent notched member;

the notched member includes a first supporting notch and a first clasp; and the adjacent notched member includes a second supporting notch and a second clasp, the first and second supporting notches and the first and second clasps operable to cooperate to receive the lateral member, the vertical member being secured between the notched member and the adjacent notched member.

19. The device of claim 16, wherein the notched member has one or more tab portions, the notched member coupled to the platform using the tab portions, the tab portions operable to slide within the channel along at least a portion of the channel.

20. The device of claim 16, wherein the notched member is operable to cooperate with the securing member to secure a fluid tube between the notched member and the securing member using the securing force, the notched member operable to allow fluid to flow within the fluid tube while the fluid tube is secured using the notched member.

21. An organizing device, comprising:

a platform having a channel; and a plurality of members coupled to the platform using the channel, each member operable to exert a force substantially continuously upon one or more adjacent members, the device operable to secure an item placed between adjacent members using the force, wherein the plurality of members includes a hooking element.

* * * * *